US010420405B1

(12) United States Patent
Lowe

(10) Patent No.: US 10,420,405 B1
(45) Date of Patent: Sep. 24, 2019

(54) COIN BANK NIGHT LIGHT

(71) Applicant: Perine Lowe, Inc., Brea, CA (US)

(72) Inventor: Patrice Lowe, Brea, CA (US)

(73) Assignee: Perine Lowe, Inc., Brea, CA (US)

( * ) Notice: Subject to any disclaimer, the term of this patent is extended or adjusted under 35 U.S.C. 154(b) by 0 days.

(21) Appl. No.: 16/156,091

(22) Filed: Oct. 10, 2018

Related U.S. Application Data

(60) Provisional application No. 62/571,055, filed on Oct. 11, 2017.

(51) Int. Cl.

| | |
|---|---|
| ***A63H 1/12*** | (2006.01) |
| ***A45C 1/12*** | (2006.01) |
| ***F21V 19/04*** | (2006.01) |
| ***F21V 3/04*** | (2018.01) |
| ***F21V 33/00*** | (2006.01) |
| ***F21S 6/00*** | (2006.01) |
| *F21W 121/00* | (2006.01) |
| *F21S 9/02* | (2006.01) |

(52) U.S. Cl.
CPC ..... *A45C 1/12* (2013.01); *F21S 6/002* (2013.01); *F21V 3/049* (2013.01); *F21V 19/04* (2013.01); *F21V 33/0028* (2013.01); *F21S 9/02* (2013.01); *F21W 2121/008* (2013.01)

(58) Field of Classification Search
CPC .... A45C 1/12; F21S 6/002; F21S 9/02; F21V 33/0028; F21V 3/049; F21V 19/04; F21W 2121/008
USPC ..... 446/8, 9, 12, 91; 362/101, 124, 253, 362/410, 414; 434/107, 19, 110
See application file for complete search history.

(56) References Cited

U.S. PATENT DOCUMENTS

| | | | | |
|---|---|---|---|---|
| 1,957,763 | A * | 5/1934 | Dupler | F21V 33/00 362/280 |
| 2,421,958 | A * | 6/1947 | Moretti | F21S 6/004 362/124 |
| D267,283 | S * | 12/1982 | Nagode | D99/40 |
| 5,324,224 | A * | 6/1994 | Anderson | A63H 33/26 362/184 |
| 6,048,078 | A * | 4/2000 | Wang | F21S 6/002 362/253 |
| 6,454,570 | B1 | 9/2002 | Woods | |
| 6,527,415 | B1 | 3/2003 | Scimone | |
| 8,075,362 | B2 * | 12/2011 | Hardin | A45C 1/12 446/10 |
| 2005/0213330 | A1 * | 9/2005 | Abish | A47G 33/00 362/283 |

(Continued)

FOREIGN PATENT DOCUMENTS

| | | |
|---|---|---|
| CN | 201278895 Y | 7/2009 |
| CN | 201898987 U | 7/2011 |

(Continued)

OTHER PUBLICATIONS

"Pillowfort : Nightlights" product page on Target.com obtained Oct. 3, 2018 from https://www.target.com/c/nightlights-home-improvement/pillowfort/-/N-u5fp0Zo212a.

(Continued)

*Primary Examiner* — Nini F Legesse
(74) *Attorney, Agent, or Firm* — Lodestone Legal Group; Jeromye V. Sartain

(57) ABSTRACT

A coin bank night light apparatus comprising a coin bank and a light unit removably engageable therewith.

20 Claims, 11 Drawing Sheets

(56) References Cited

U.S. PATENT DOCUMENTS

| | | | | |
|---|---|---|---|---|
| 2008/0108272 | A1* | 5/2008 | Lin | A45C 1/12<br>446/8 |
| 2008/0233829 | A1* | 9/2008 | Sayles | A45C 1/12<br>446/8 |
| 2008/0310149 | A1* | 12/2008 | Chan | F21S 6/001<br>362/186 |
| 2015/0034712 | A1* | 2/2015 | Moore | A63H 3/005<br>232/4 R |

FOREIGN PATENT DOCUMENTS

| | | | |
|---|---|---|---|
| CN | 102759042 | A | 10/2012 |
| CN | 202800434 | U | 3/2013 |
| CN | 103149834 | A | 6/2013 |
| CN | 203771177 | U | 8/2014 |
| EP | 1050867 | A2 | 8/2000 |

OTHER PUBLICATIONS

Photo of Pillowfort nightlight taken on or about Jul. 22, 2016.

* cited by examiner

COIN BANK NIGHT LIGHT

RELATED APPLICATIONS

This non-provisional patent application claims priority pursuant to 35 U.S.C. § 119(e) to and is entitled to the filing date of U.S. Provisional Patent Application Ser. No. 62/571,055 filed Oct. 11, 2017, and entitled "Coin Bank Night Light." The contents of the aforementioned application is incorporated herein by reference.

BACKGROUND

The subject of this patent application relates generally to coin banks or "piggy banks," and more particularly to a coin bank configured with a removable internal light source and one or more openings in the coin bank so as to selectively provide an aesthetically-pleasing night light.

The following description includes information that may be useful in understanding the present invention. It is not an admission that any of the information provided herein is prior art or relevant to the presently claimed invention, or that any publication specifically or implicitly referenced is prior art.

Applicant(s) hereby incorporate herein by reference any and all patents and published patent applications cited or referred to in this application, to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

By way of background, "piggy banks" date back centuries, long before such coin banks were fashioned as the "pig" animal. Traditional etymology ascribes the term "piggy bank" as being derived from "pygg pots" or "pygg jars," containers of various shapes used to store coins and made from "pygg," an orange-colored clay commonly used in the Middle Ages. Over time, as essentially a "play on words," "piggy banks" or coin banks fashioned in the form of a "pig" became popular, particularly for use by children. Today, such piggy banks are usually made of ceramic or porcelain but have evolved to be configured in a virtually infinite variety of forms and designs fashioned from a number of different materials, all such banks still often being referred to as "piggy banks" or "penny banks" or "money boxes," whether shaped as a pig or box or storing coins other than pennies. Such coin banks or "still banks" typically are formed with an outer wall and hollow interior, with a single slot somewhere near the top that communicates through the outer wall with the interior space and then a plugged opening somewhere in the outer wall near the bottom for selective removal of coins from the bank.

More recently, additional functionality for piggy banks or coin banks has been proposed, ranging from the incorporation of sophisticated counters and related displays to clocks and thermostats to lighting of various kinds. Regarding lighting, all known instances generally involve external lighting in the more traditional sense of an area or desk lamp or particular external lighting configured for illumination of other functional aspects of the bank, to serve an aesthetic effect consistent with the bank's ornamental design, or for alternative function of the bank as a flashlight, for example. In all such known configurations, and even if a light may be included internally, the lighting assembly is integral with the structure and electronics of the bank itself and not separable therefrom or self-contained, nor is the outer wall of the bank formed with selective openings for the passage therethrough of an internally-emitted light for an improved aesthetic effect. It is therefore desirable to provide and has heretofore been unavailable a more universal coin bank night light that conveniently may be removably engaged with a number of coin banks and thereby provide improved function and aesthetics.

Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing a coin bank night light apparatus comprising a coin bank and a light unit removably engageable therewith. In at least one embodiment, the coin bank comprises an outlet and the light unit comprises a base configured to be selectively seated within the outlet.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Figure 1:
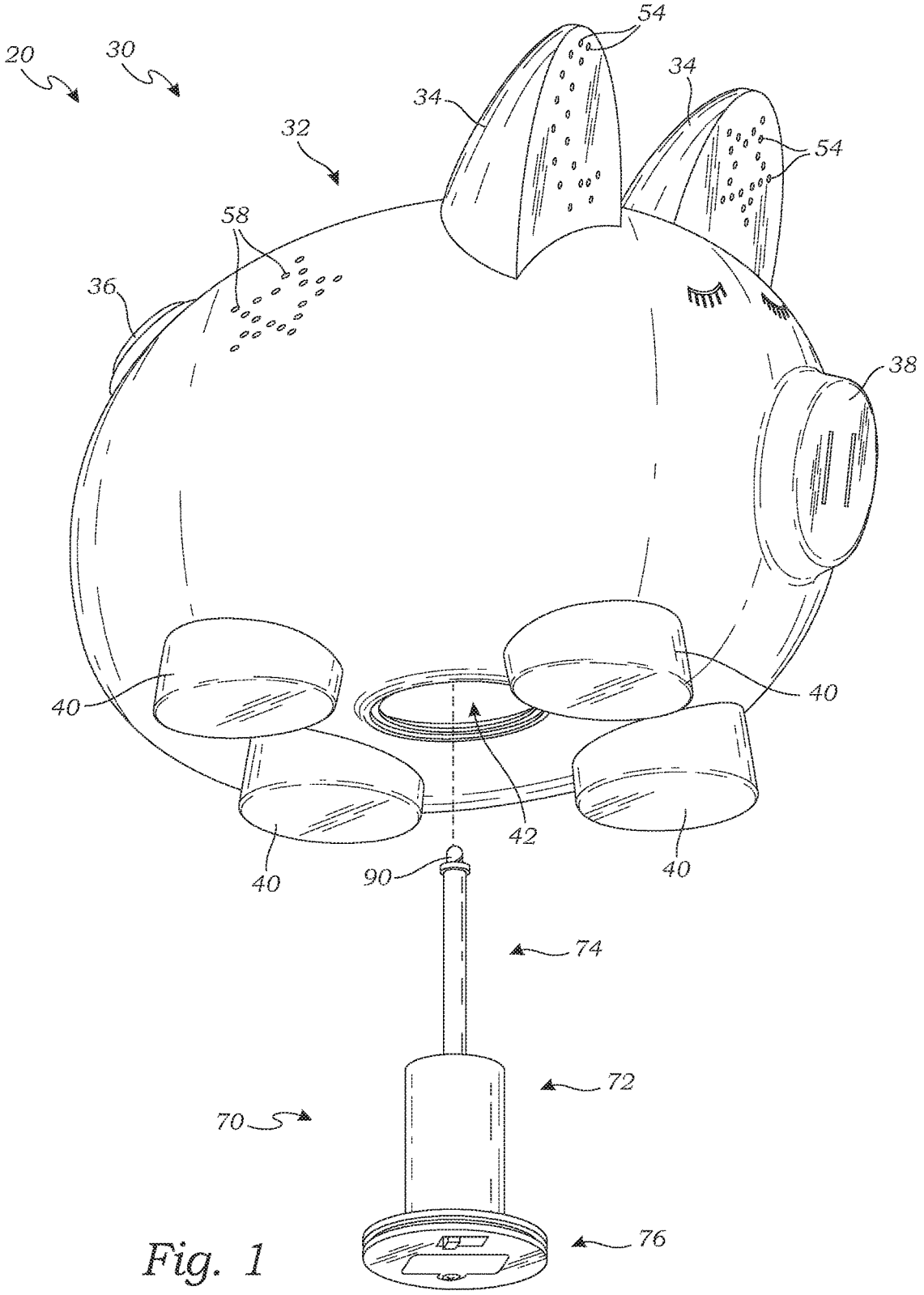
FIG. 1 is an exploded bottom perspective view of an exemplary coin bank night light, in accordance with at least one embodiment.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments. More generally, those skilled in the art will appreciate that the drawings are schematic in nature and are not to be taken literally or to scale in terms of material configurations, sizes, thicknesses, and other attributes of an apparatus according to aspects of the present invention and its components or features unless specifically set forth herein.

DETAILED DESCRIPTION

The following discussion provides many exemplary embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

While the inventive subject matter is susceptible of various modifications and alternative embodiments, certain illustrated embodiments thereof are shown in the drawings and will be described below in detail. It should be understood, however, that there is no intention to limit the invention to any specific form disclosed, but on the contrary, the inventive subject matter is to cover all modifications, alternative embodiments, and equivalents falling within the scope of the claims.

Turning now to FIG. 1, there is shown an exploded bottom perspective view of an exemplary embodiment of a coin bank night light apparatus 20 according to aspects of the present invention. The coin bank night light apparatus 20 comprises, in the exemplary embodiment, a coin bank 30 and a removably engageable light unit 70 configured to selectively extend within the interior of the coin bank 30 and thereby selectively provide illumination through one or more holes or openings 54, 56, 58 formed in the outer wall 32 of the coin bank 30. As a threshold matter, while the coin bank 30 is shown as or in the form of a "pig" or a "piggy bank" in the traditional sense, it will be appreciated that the coin bank 30 can take virtually any form without departing from the spirit and scope of the invention, such that the illustrated "piggy bank" coin bank 30 is to be understood as merely exemplary and non-limiting. Any such coin bank 30 may also be formed of any suitable material employing any appropriate manufacturing method now known or later developed. As illustrated, the outer wall 32 of the coin bank 30 of whatever configuration may be formed having an outlet 42, which for both functional and aesthetic purposes is typically formed in the bottom region of the coin bank 30. The removable light unit 70 is formed having a base 76 configured to engage the outlet 42 so as to selectively position the light unit 70, and particularly a body 72 and stem 74 thereof having a light source 90 at its distal end, within the coin bank 30, with the base 76 conveniently taking the place of and functioning as the plug (not shown) that is typically provided for removable insertion in the outlet 42 so as to retain the coins C (FIG. 7) within the coin bank night light apparatus 20 until they are to be removed, more about which is said below in connection with the sectional views of FIGS. 3 and 4. As best seen in the assembled bottom perspective view of FIG. 2, when the light unit 70 is fully seated within the coin bank 30 its base 76 is substantially flush with the outer wall 32 in the vicinity of the outlet 42, with the switch 86 and the battery door 88 thereof still being accessible and the remainder of the light unit 70 again being housed within the outer wall 32 of the coin bank 30. It will be appreciated that by forming the outer wall 32 with one or more openings 54, 56, 58 and then selectively operating the light unit 70 via the switch 86 to illuminate the light source 90 thereof within the coin bank 30, such light would then pass out of the coin bank 30 through the openings 54, 56, 58 as herein described, particularly with reference to FIGS. 11 and 12 regarding the coin bank night light apparatus 20 in use as discussed further below.

Figure 2:
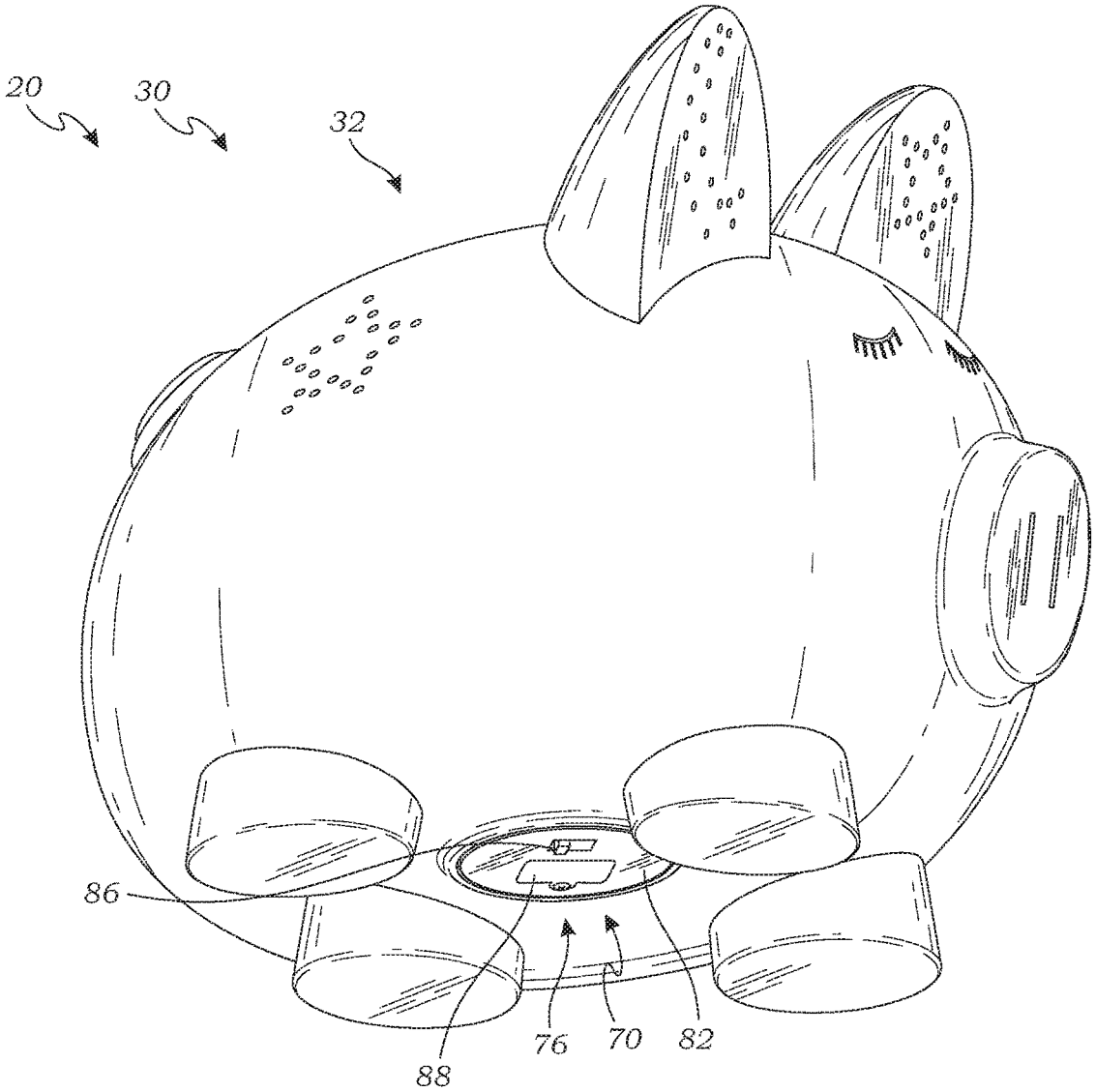
FIG. 2 is an assembled bottom perspective view thereof, in accordance with at least one embodiment.
Figure 3:
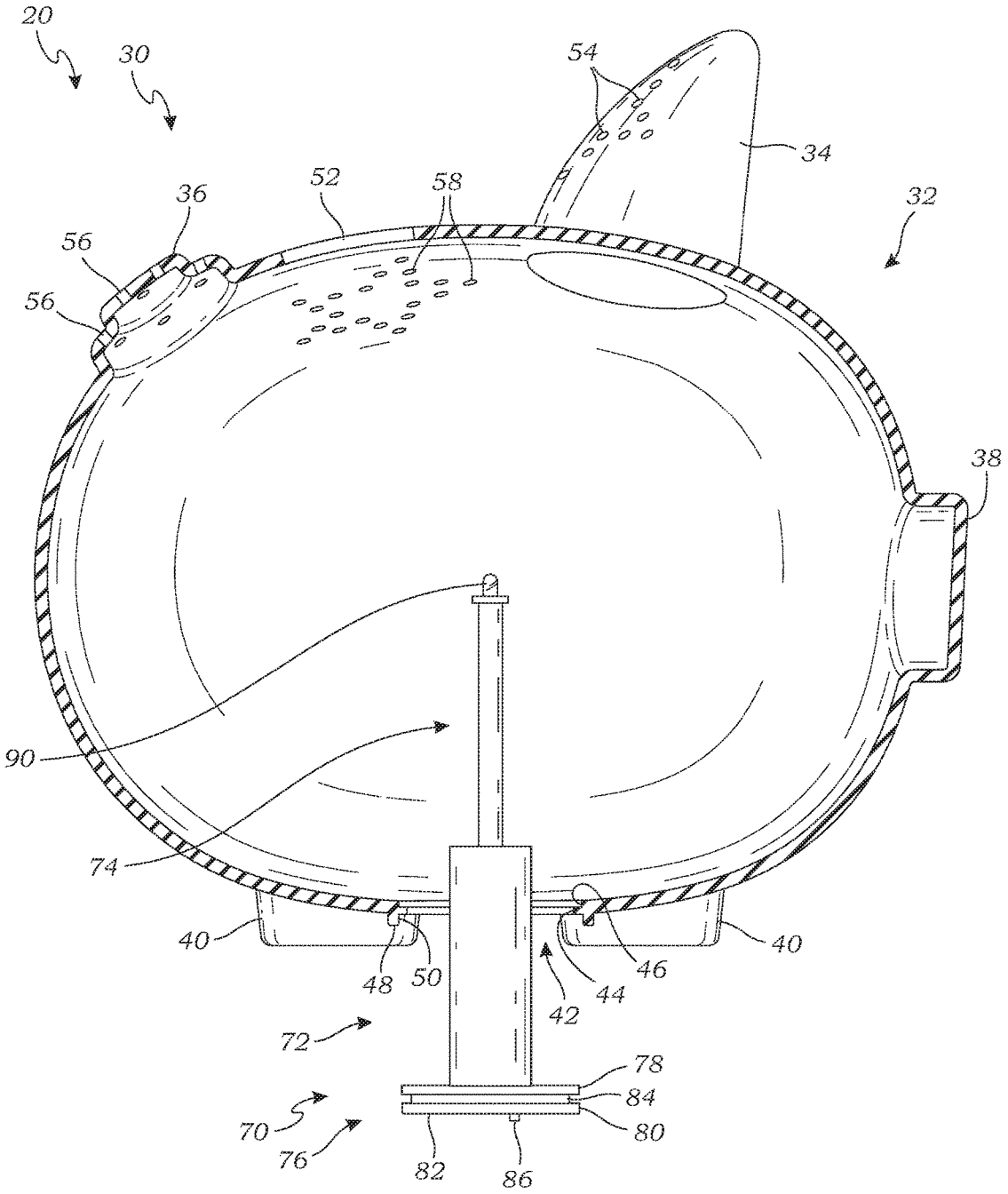
FIG. 3 is an exploded cross-sectional view thereof, in accordance with at least one embodiment.
Figure 4:
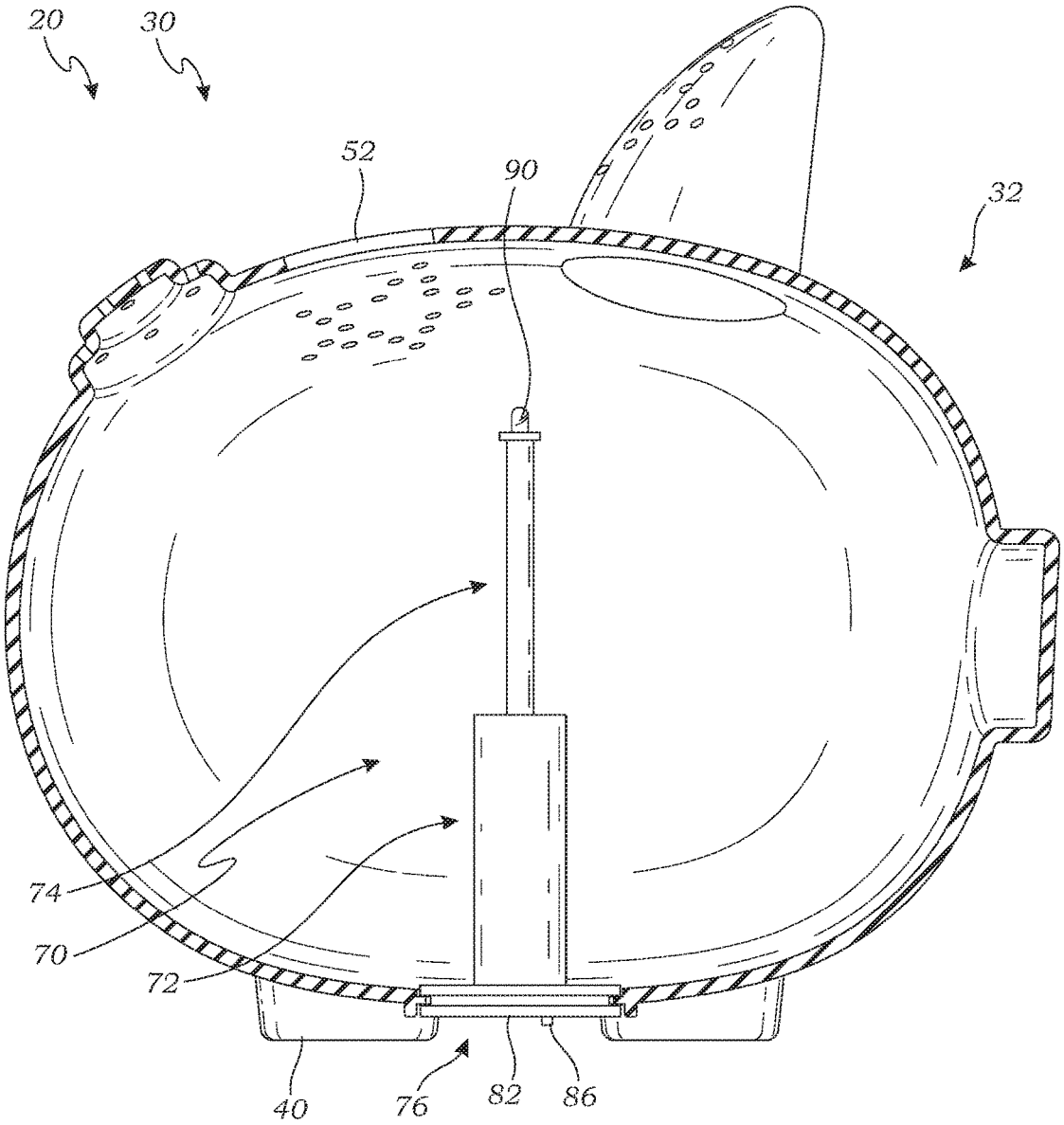
FIG. 4 is an assembled cross-sectional view thereof, in accordance with at least one embodiment.

With continued reference to FIGS. 1 and 2, in the exemplary embodiment wherein the coin bank 30 is fashioned as a "piggy bank," the outer wall 32 is further formed with one or more outwardly-projecting features 34, 36, 38, 40, on one or more of which may be formed one or more of the openings 54, 56, 58. Particularly, the coin bank 30 is shown as being formed somewhat forwardly with first outwardly-projecting features 34 extending from the outer wall 32 in the form of two offset somewhat upwardly oriented pig ears, a second outwardly-projecting feature 36 extending from the outer wall 32 somewhat rearwardly somewhat in the form of a pig tail, a third outwardly-projecting feature 38 extending from the outer wall 32 forwardly below the pig ears 34 in the form of a pig snout, and fourth outwardly-projecting features 40 extending somewhat downwardly from the outer wall 32 in the form of four spaced-apart pig feet. As shown, one or more first openings 54 may be formed in the first outwardly-projecting features 34, one or more second openings 56 may be formed in the second outwardly-projecting feature 36, and one or more third openings 58 may be formed in the outer wall 32 itself. More particularly, in the illustrated embodiment, multiple first openings 54 are formed in each of the pig ear first outwardly-projecting features 34, a set of openings 54 in one ear 34 forming a crescent moon pattern and a set of openings 54 in the other ear 34 forming a star pattern, for example. Similarly, as best seen in FIGS. 3 and 4, another pattern of second openings 56 may be formed in the pig tail second outwardly-projecting feature 36. And as visible from the side in FIGS. 1 and 2, an exemplary set of third openings 58 may be formed in an upper region of the coin bank outer wall 32. Though not shown, further openings may be formed in the coin bank 30, such as in other locations throughout the outer wall 32, whether in a recognizable pattern or just distributed holes to form additional points of light when the light unit 70 is operated and whether in the outer wall 32 itself or in another outwardly-projecting feature thereof, such as the third outwardly-projecting feature 38 configured as the pig's snout in the exemplary embodiment. It will be appreciated that a virtually infinite variety of such openings and patterns and locations thereof are possible according to aspects of the present invention without departing from its spirit and scope, such that those shown and described are to be understood as illustrative and non-limiting. Relatedly, while individual openings or holes of a particular size and generally circular shape are shown schematically, the invention is not so limited, those skilled in the art appreciating that individual openings may also be formed having shapes other than circular.

Referring next to the exploded and assembled cross-sectional views of the exemplary coin bank night light apparatus 20 according to aspects of the present invention as shown in FIGS. 3 and 4, the coin bank night light apparatus 20 once again generally comprises a coin bank 30 and a removably engageable light unit 70 configured to selectively extend within the interior of the coin bank 30. The light unit 70 comprises a main body 72 having an upwardly oriented stem 74 extending distally therefrom and an opposite base 76 formed proximally on the body 72 and configured for seating within the outlet 42 of the coin bank 30. Particularly, the outlet 42 is shown as being formed having a radially-inwardly-projecting lip 44 defining an inwardly-opening recess 46 and a downwardly and outwardly-projecting lip 48 defining together with the radially-inwardly-projecting lip 44 an outwardly-opening recess 50. The base 76 of the light unit 70 is then formed having complimentary features, namely, an upper radially-outwardly-projecting flange 78 configured to seat within the inwardly-opening recess 46, an opposite, substantially parallel and spaced apart lower radially-outwardly-projecting flange 80 configured to seat within the outwardly-opening recess 50, and a radially-outwardly-opening undercut 84 formed between the upper and lower outwardly-projecting flanges 78, 80 and configured to receive therein the radially-inwardly-projecting lip 44, as best seen in the assembled cross-sectional view of FIG. 4. Accordingly, it follows that in the exemplary embodiment the outside diameter or perimeter of the upper and lower outwardly-projecting flanges 78, 80 is to be greater than the inside diameter or perimeter of the radially-inwardly-projecting lip 44 such that there is at least partial surface-to-surface engagement of these features when the light unit 70 is fully inserted or seated within the coin bank 30 so as to retain the light unit 70 therein until it is to be removed. It similarly follows that the outside diameter or perimeter of the upper and lower outwardly-projecting flanges 78, 80 is to be less than the inside diameter or perimeter of the respective inwardly- and outwardly-opening recesses 46, 50. It will be appreciated by those skilled in the art that such features and engagement and relative sizes are exemplary and non-limiting. As will also be appreciated, the outside dimensions of both the body 72 and the stem 74 of the light unit 70 are to be smaller than the opening or outlet 42 formed in the wall 32 of the coin bank 30 so as to provide clearance relative to the outlet 42 and allow passage therethrough of the body 72 and the stem 74 when installing the light unit 70 as shown. Relatedly, while all such features of both the light unit 70 and the related opening or outlet 42 of the coin bank 30 are shown as being substantially round or annular, the invention is not so limited and may take other forms in the practice thereof. In any case, engagement between the base 76 of the light unit 70 and the outlet 42 of the coin bank 30 may be circumferential or full or only partial. Regarding the exemplary embodiment shown wherein the upper and lower outwardly-projecting flanges 78, 80 seat about, or above and below, respectively, the radially-inwardly-projecting lip 44 of the outlet 42, it will be further appreciated that in practice in pushing the base 76 of the light unit 70 into or extracting such out of the opening or outlet 42 in the manner or engagement illustrated, preferably the base 76, or at least the perimeter thereof, particularly of the upper radially-outwardly-projecting flange 78, is in the exemplary embodiment formed of a somewhat flexible or resilient material that would allow the respective appropriate portions to bend and/or compress as passed by the radially-inwardly-projecting lip 44, which it will be appreciated may be relatively rigid if formed with the rest of the coin bank 30, and the wall 32 thereof particularly, of a material such as ceramic or metal. In such embodiment, in practice, the entire base 76 may be formed of a resilient material such as rubber or plastic or only a portion thereof, such as the perimeter. In either case, the base 76 may be formed so as to be unitary with and of the same material as the body 72 of the light unit 70 or may be formed of a different material to suit such selective installation of the light unit 70 within the coin bank 30, with such base 76 or portion thereof of different material being then installed on the balance of the light unit 70 as through a bonding, press-fit, over-molding or other such technique now known or later developed. In an alternative exemplary embodiment thereof, only the upper radially-outwardly-projecting flange 78 is formed of a resilient or flexible material installed on an otherwise relatively rigid base 76 and body 72 of the light unit 70, again in any appropriate manner now known or later developed. In any such construction, the downwardly-facing or bottom wall 82 defining, in part, the lower radially-outwardly-projecting flange 80, whether relatively flexible or relatively rigid, may also be formed having a pull tab or other such feature (not shown) to facilitate grasping of the bottom wall 82 or base 76 of the light unit 70 for selective removal thereof from the coin bank 30. Alternatively, in a still further exemplary embodiment, the entire light unit 70, including the base 76, may be formed of a relatively rigid plastic or other material and a gasket made of rubber or other such material may be affixed within the outlet 42 of the coin bank 30 so as to form a relatively resilient or flexible radially-inwardly-projecting lip 44. Or as a further alternative embodiment, both the base 76 of the light unit 70, and particularly at least the upper radially-outwardly-projecting flange 78, and the radially-inwardly-projecting lip 44 may be formed from a relatively resilient or flexible material. Those skilled in the art will further appreciate that a variety of other mechanical and other such arrangements for removable engagement of the light unit 70 within the coin bank 30, whether now known or later developed, are possible according to aspects of the present invention, including but not limited to press- or interference-fit, threads, keys, channels or grooves, or other such temporary or removable engagement means, such that the engagement features shown and described herein are to be understood as merely illustrative and non-limiting.

Figure 9:
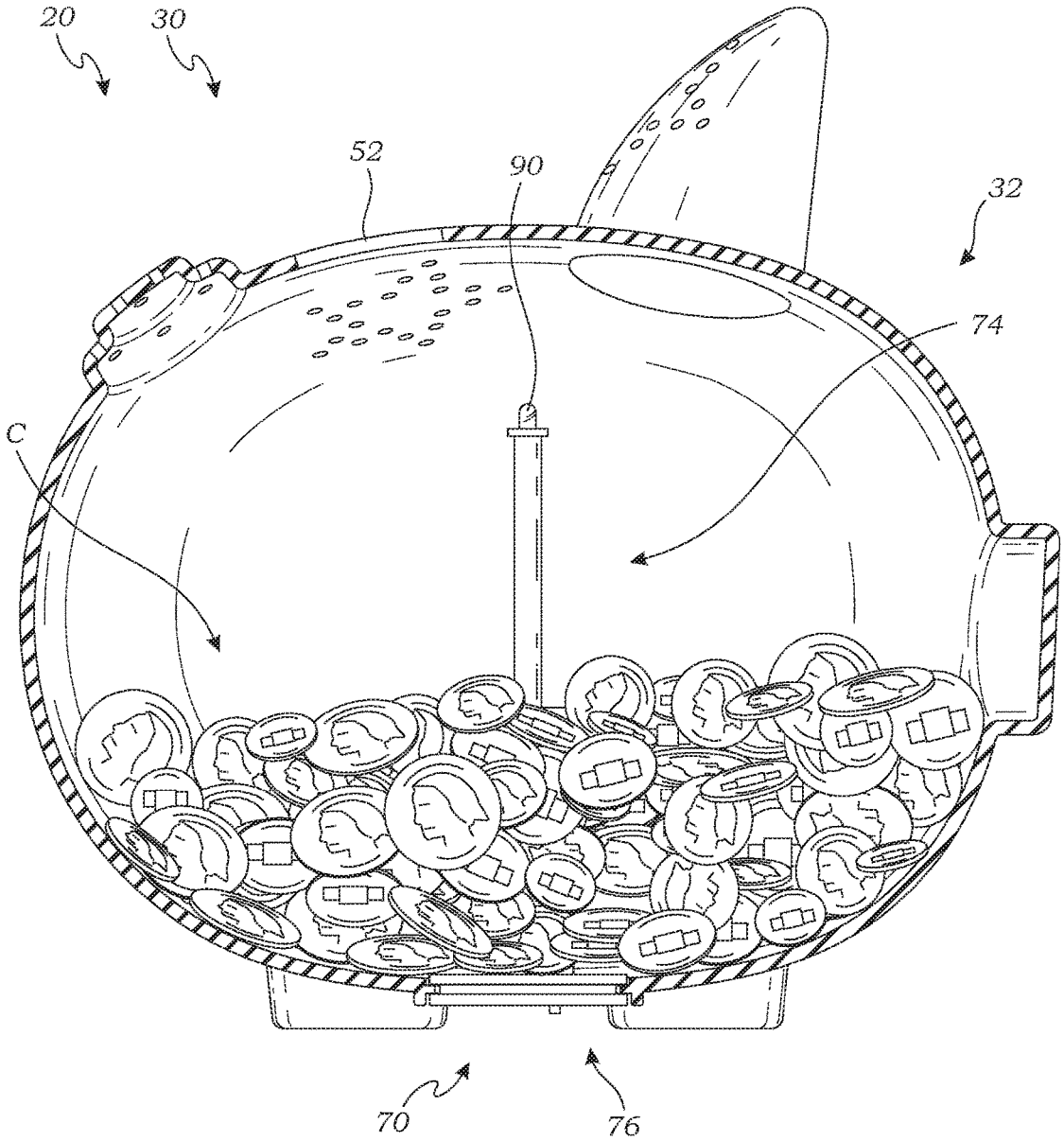
FIG. 9 is an assembled cross-sectional view of the exemplary coin bank night light of FIGS. 1-4 in use in a first operational mode, in accordance with at least one embodiment.
Figure 10:
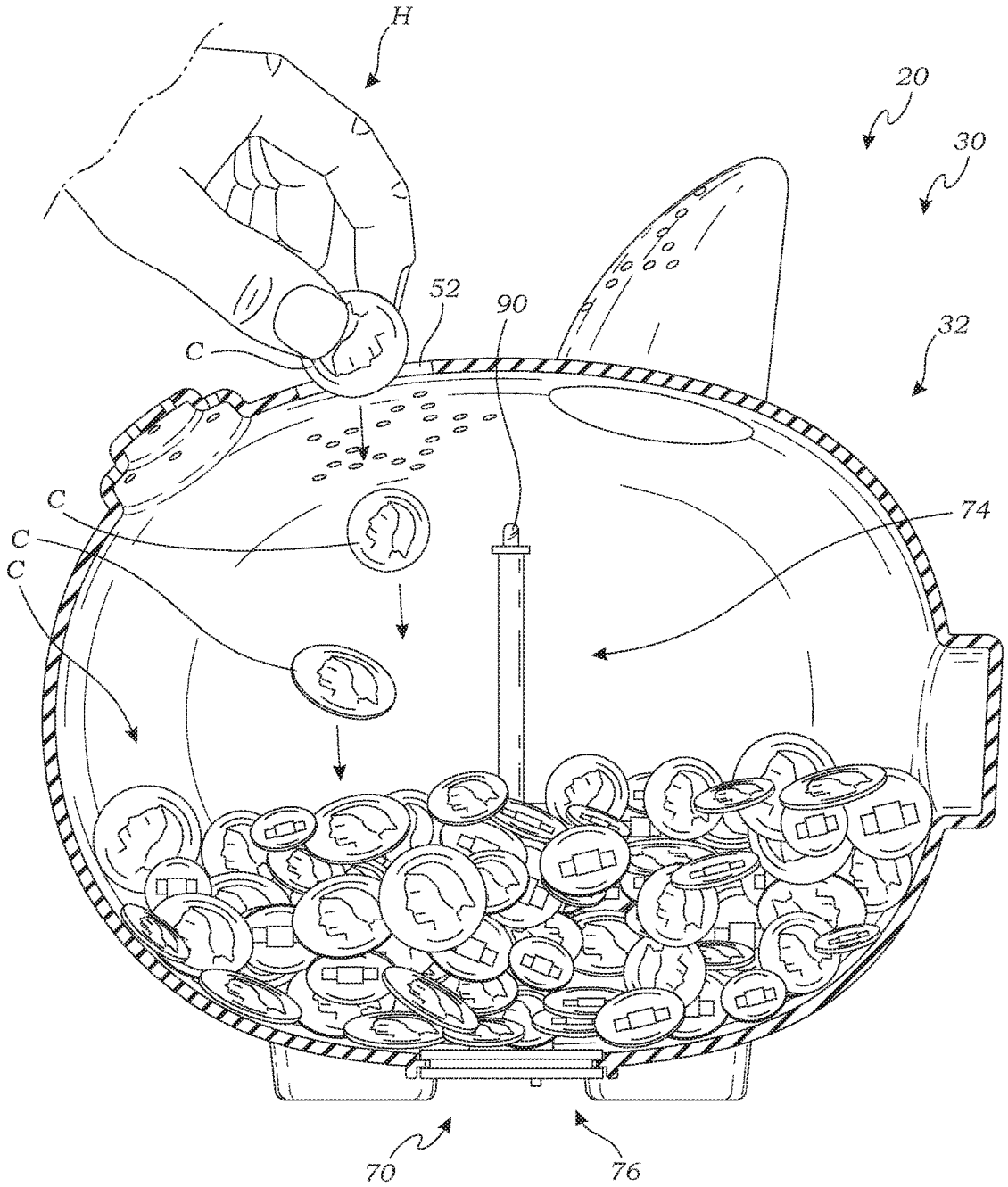
FIG. 10 is an assembled cross-sectional view of the exemplary coin bank night light of FIGS. 1-4 in use in a second operational mode, in accordance with at least one embodiment.
Figure 11:
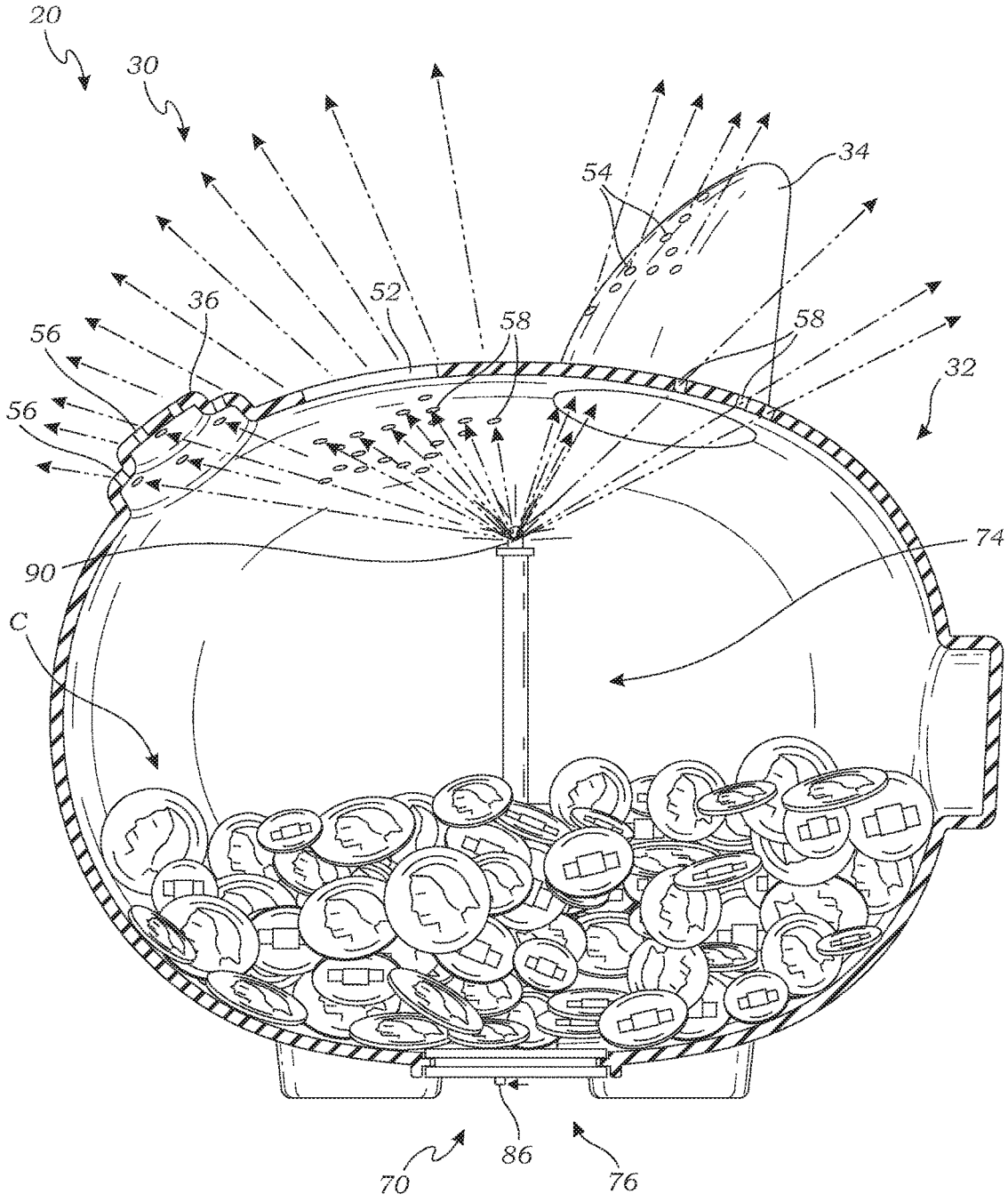
FIG. 11 is an assembled cross-sectional view of the exemplary coin bank night light of FIGS. 1-4 in use in a third operational mode, in accordance with at least one embodiment.

As also appreciated particularly from the assembled cross-sectional view of FIG. 4, the light unit 70 is preferably formed not only as having the desired outside or perimeter features and dimensions to selectively clear or engage with the opening or outlet 42 of the coin bank 30, as discussed above, but also as having an overall length or height, as measured from the base 76 to the light source 90 at the upper or distal end of the stem 74 such that the light source 90 is sufficiently elevated within the interior space of the coin bank 30 without getting too close to or actually touching or impacting the outer wall 32 of the coin bank 30. Another somewhat related geometrical consideration is the vertical offset of the light unit 70, and particularly the light source 90 relative to the coin slot 52 formed in the upper region of the wall 32 of the coin bank 30 to allow for the insertion of coins C with minimal risk of damage to the light source 90, as discussed further below in connection with FIG. 10. As shown in the exemplary embodiment, the components of the light unit 70, namely, the body 72, the stem 74 with light source 90, and the base 76, are substantially vertically aligned or are substantially coaxial. Those skilled in the art will appreciate that such arrangement is not required and so is merely illustrative and non-limiting. For example, even if rigid, the stem 74 may be formed at an angle relative to the body 72 or be curved or stepped or some other configuration other than substantially linear. Additionally or alternatively, the stem 74 may be flexible or articulable or bendable so as to allow it to be selectively configured to position the light source 90 as desired within the coin bank 30 relative to the coin slot 52 specifically and the coin bank outer wall 32 more generally. In any such embodiments, it would be possible to have the outlet 42 and thus the light unit 70, and particularly the base 76 and the body 72, positioned substantially directly beneath the coin slot 52, while then employing an angled or otherwise repositioned stem 74 to locate the light source 90 out of axis or away from underneath the coin slot 52. In this way, not only is the light source 90 protected, again, more about which is said in connection with FIG. 10, but by being able to position the light source 90 in various locations forwardly or rearwardly different lighting effects relative to the various openings 54, 56, 58 may be achieved. Relatedly, while one stem 74 and light source 90 are shown, it will be appreciated that multiple ones of either feature may be provided on or as part of the light unit 70, again, for various lighting effects and other purposes. By way of illustration and not limitation, two or more light sources 90 may be positioned on a single stem 74 or one or more stems 74 with one or more light sources 90 each may be provided. In the exemplary embodiment, the overall dimensions of the light unit 70 are such that the base 76 is nominally one-and-a-half to two inches (1.5-2 in.) in diameter and the overall length or height of the light unit 70 from its base 76 to its one or more light source 90, assuming for this purpose a linear arrangement of the unit 70 is nominally in the range of three to six inches (3-6 in.). It will be appreciated by those skilled in the art that such dimensions are merely illustrative and non-limiting and can vary widely depending on the configuration of the coin bank 30. As will be appreciated from the below discussion in connection with FIGS. 9-11 illustrating an exemplary coin bank night light apparatus 20 according to aspects of the present invention in use in various modes of operation, it is preferable that the light unit 70 be configured in such a way that the light source 90 would not be obscured by coins C as the coin bank 30 fills up, on which basis in a further exemplary embodiment the invention is characterized in that the overall length or height of the light unit 70 is greater than or equal to half the height of the interior space of the coin bank 30. Again, those skilled in the art will appreciate that the sizes and shapes of coin or "piggy" banks vary widely, such that any such dimensions associated with the light unit 70 can also vary widely and proportionately. In any case, it will again be appreciated that the light unit 70 is a self-contained assembly configured to be separable from and selectively used in conjunction with a wide array of coin banks 30 having some sort of opening or outlet 42 that is typically plugged until coins C are to be removed therefrom, the light unit 70 conveniently and cleverly substituting for and providing the function of a typical plug (not shown) used to plug the outlet 42 while also selectively providing within the same unit 70 the additional functionality of internal lighting within the coin bank 30 when installed. So long as the light unit 70, and particularly or typically the base 76, is able to engage with or seat in the coin bank outlet 42, the coin bank 30 would be able to accommodate the light unit 70 and provide the beneficial functionality herein described.

Figure 5:
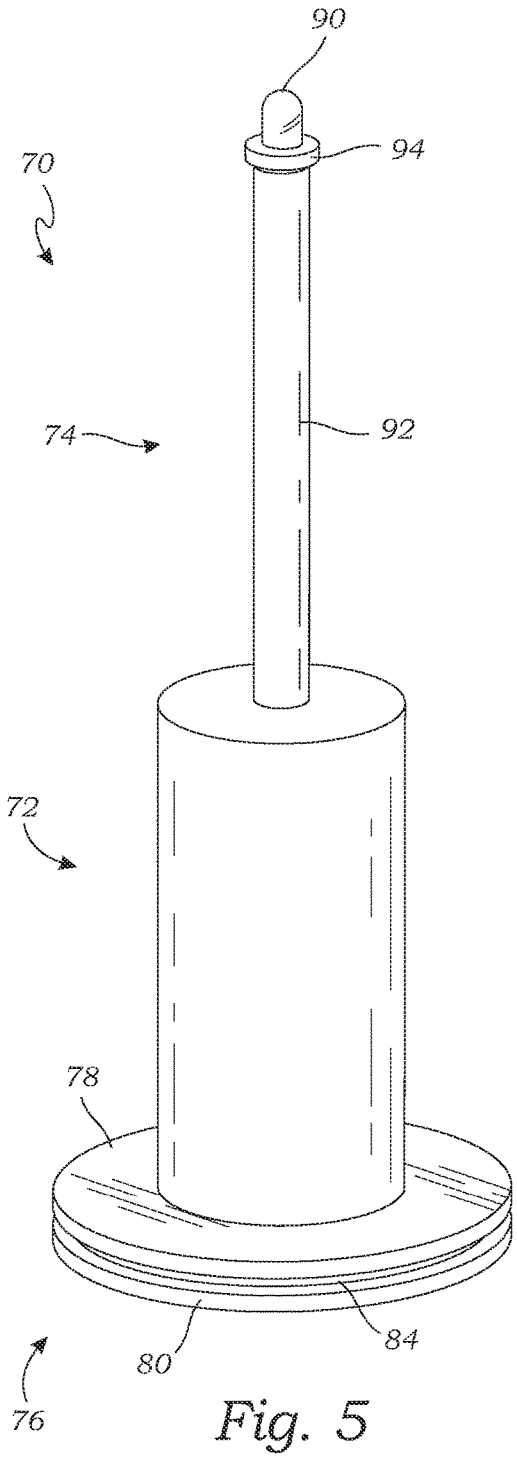
FIG. 5 is an enlarged top perspective view of an exemplary light unit thereof, in accordance with at least one embodiment.
Figure 6:
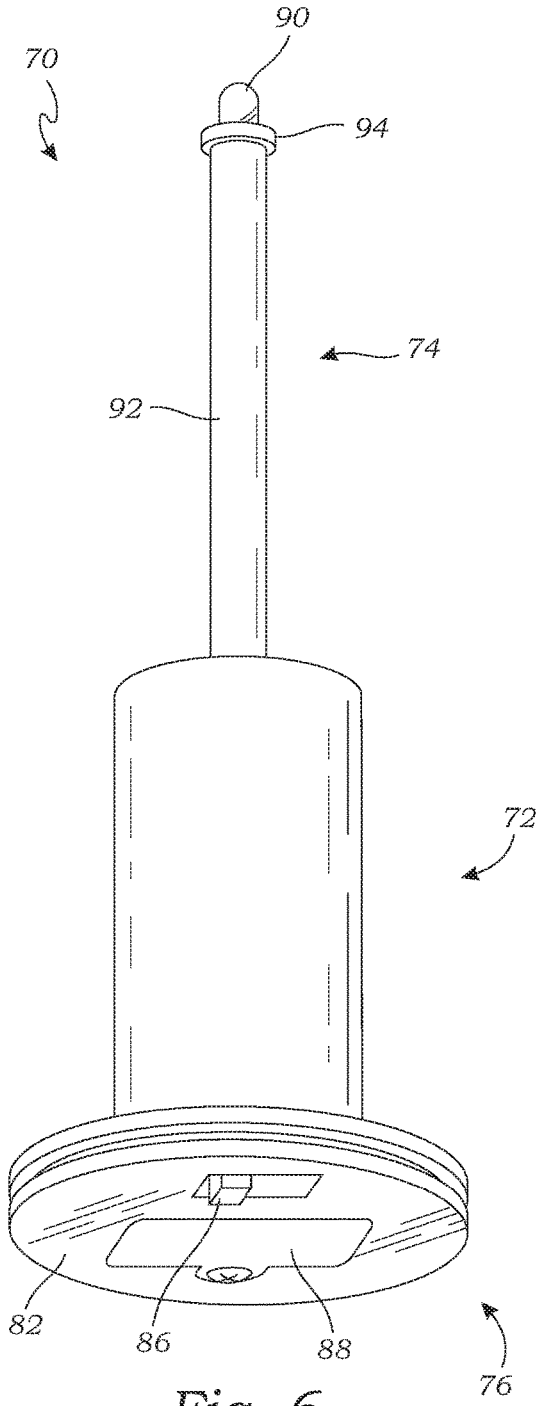
FIG. 6 is a bottom perspective view of the light unit of FIG. 5, in accordance with at least one embodiment.

Turning to FIGS. 5 and 6, there are provided enlarged perspective views of the exemplary light unit 70 as shown in FIGS. 1-4 configured for use in a coin bank night light apparatus 20 according to aspects of the present invention. The light unit 70 is once more shown as comprising a main body 72 having an upwardly oriented stem 74 extending distally therefrom and an opposite base 76 formed proximally on the body 72 and configured for seating within the outlet 42 of the coin bank 30 (FIGS. 1-4). Once more, the stem 74 may be rigid or flexible and formed of any suitable material and in any appropriate configuration now known or later developed for the purpose of elevating the light source 90 installed on the distal end of the stem 74 and in exemplary embodiments positioning the light source 90 so as to not be directly beneath the coin slot 52 of the coin bank 30 (FIGS. 3 and 4). By way of illustration and not limitation, the stem 74 may be formed having an annular shaft 92 of a relatively rigid plastic material that is coextensive or integral with the body 72, as through a molding or extrusion process. Alternatively, the shaft 92 may be made of metal as through a machining or extrusion process and then affixed within the body 72. By way of further illustration, whether plastic or metal or some other material now known or later developed, and whether integral with the body 72 or formed separately therefrom and then installed on the body 72, the stem 74, and the shaft 92 particularly, may be formed of a material and/or mechanical configuration so as to be articulable for purpose of selectively positioning the light source 90 relative to the body 72 and base 76 of the light unit 70 and ultimately, again, relative to the bank's coin slot 52. Accordingly, in one exemplary embodiment the shaft 92 may be formed of a material that effectively has little to no memory so that it can be bent or flexed into a desired position and stay in that position until again manipulated rather than reverting or springing back to an original, "at rest" or "memorized" position. In an alternative embodiment, the shaft 92 is not solid but instead comprised of multiple discrete linkages in series (not shown) for purposes of articulation of the overall stem 74 as respective ones of the linkages are rotated or angled relative to another, the shaft 92 essentially being configured as a flexible arm and able to take any such form now known or later developed. As shown, at the distal end of the shaft 92 there may be formed a mount 94, here configured as an annular flange or shelf, on which the light source 90 may be operably installed. Those skilled in the art will appreciate that the light source 90 may comprise one or more of any bulb or other lighting or light-producing device now known or later developed, including but not limited to LED bulbs, which are presently used in a wide range of industries due to their reduced energy consumption and heat production and thus their durability and performance over incandescent, fluorescent, halogen and other bulbs, though it will once again be appreciated that any such bulbs may be employed as well. Accordingly, the attachment or operable engagement of the light source 90 with the stem 74 particularly in connection with the mount 94 at the distal end of the shaft 92, may be permanent or removable, the former as through a hard-wired, soldered, bonded, or other such connection and the latter as through a press- or interference-fit, threads, keys, channels or grooves, or other such temporary or removable engagement means, in any case while still facilitating an electrical connection with the internal power and other circuitry (not shown) of the light unit 70. It will be appreciated that selection of a light source 90 such as an LED bulb along with including in the circuitry of the light unit 70 the necessary LED driver and other controls, a range of bulb lighting adjustments can be selectively made by a user, such as light intensity (dimming or brightening), light color (actually changing the color of the output light through the electronic control of the LED bulb or lamp itself rather than using filters or the like), and light effects (pulsing or cycling), for example. Accordingly, and with particular reference to the bottom perspective view of FIG. 6, while a simple on-off switch 86 is shown as part of the electronics operably contained in the light unit 70, which is also electrically connected to internal circuitry (not shown) so as to directly or indirectly control power from any battery housed in the unit 70 to the one or more lights 90 incorporated therein, it will again be appreciated that other such electronics components now known or later developed may be incorporated in a light unit 70 according to aspects of the present invention without departing from its spirit and scope. By way of illustration and not limitation, additional switches or controls may be installed in or accessible at the bottom wall 82 for selectively controlling the light unit 70 without removing it from the coin bank 30. Moreover, other switches or controls may also be provided on the body 72 for making certain selections regarding the operation or mode of the light unit 70 before it is installed in the coin bank 30. Those skilled in the art will again appreciate that such settings may include light intensity or color or whether the light will be "steady on" versus phased, pulsed, or the like. The light unit 70 may also be programmable, such that the light unit 70 may be set, regardless of the operational mode selected, to come on and go off at a certain time of day or to stay on for a certain amount of time and then go off (e.g., a timer that can be set to an hour), for example. It is even possible to equip the light unit 70 with wireless communication capabilities so that it may be operated remotely, including turning it on and off and changing its settings, as from a smartphone app or other computing device in a manner now known or later developed in the art. Again, any such electronics components and features and functionality of the light unit 70 consistent with aspects of the present invention may be employed in various combinations without departing from its spirit and scope. With continued reference to FIG. 6, also formed or installed in the bottom wall 82 of the base 76 is a battery door 88 for providing access to the one or more batteries positioned internally in a manner known in the art for providing electrical power to other circuit elements (not shown) and to the light source 90 itself. It will be appreciated that the batteries and other such electronics or electrical components (not shown) may be designed and configured or selected to be operably housed within the body 72 of the light unit 70; that is, the body 72 may be designed and configured to house the selected electronics components and provide selective access thereto for production and maintenance purposes. While a hinged battery door 88 is shown as having a single screw for securement of the otherwise free side of the door 88 opposite a hinge, tongue-and-groove fit or other such engagement feature, it will be appreciated that other configurations of the door 88 are possible, such that that shown is merely illustrative and non-limiting. Moreover, it will be appreciated that other forms or sources of power now known or later developed may be employed instead of or in addition to the one or more batteries herein contemplated, including but not limited to AC and solar power. Where one or more batteries are employed, they may or may not be rechargeable, in part depending on the power demand as dictated by the design of the light unit 70. Where the light unit 70 is to have a rechargeable battery or run on AC power, a plug (not shown) may be provided in the bottom wall 82 for that purpose. Those skilled in the art will appreciate that such plug may be accessed while the coin bank night light apparatus 20 is in use due to the fourth outwardly-projecting features 40 in the form of feet that elevate the bottom of the coin bank 30 from any surface it is positioned on. It will further be appreciated that the light unit 70 may operate on both AC and DC power, as where AC power is used primarily with the DC battery providing a back-up power source should AC power be lost for any reason. By way of further illustration and not limitation, instead of or in addition to batteries, the light unit 70 may thus be "corded" so as to be plugged into a typical AC outlet to power the light unit 70 and/or recharge any battery(ies) provided in the light unit 70, which cord (not shown) may be hard-wired to the light unit 70 or removably engageable therewith. Once more, any such combination of features and functionality may be employed in a coin bank night light apparatus 20, and particularly a removable and separate light unit 70 thereof, without departing from the spirit and scope of the invention.

Figure 7:
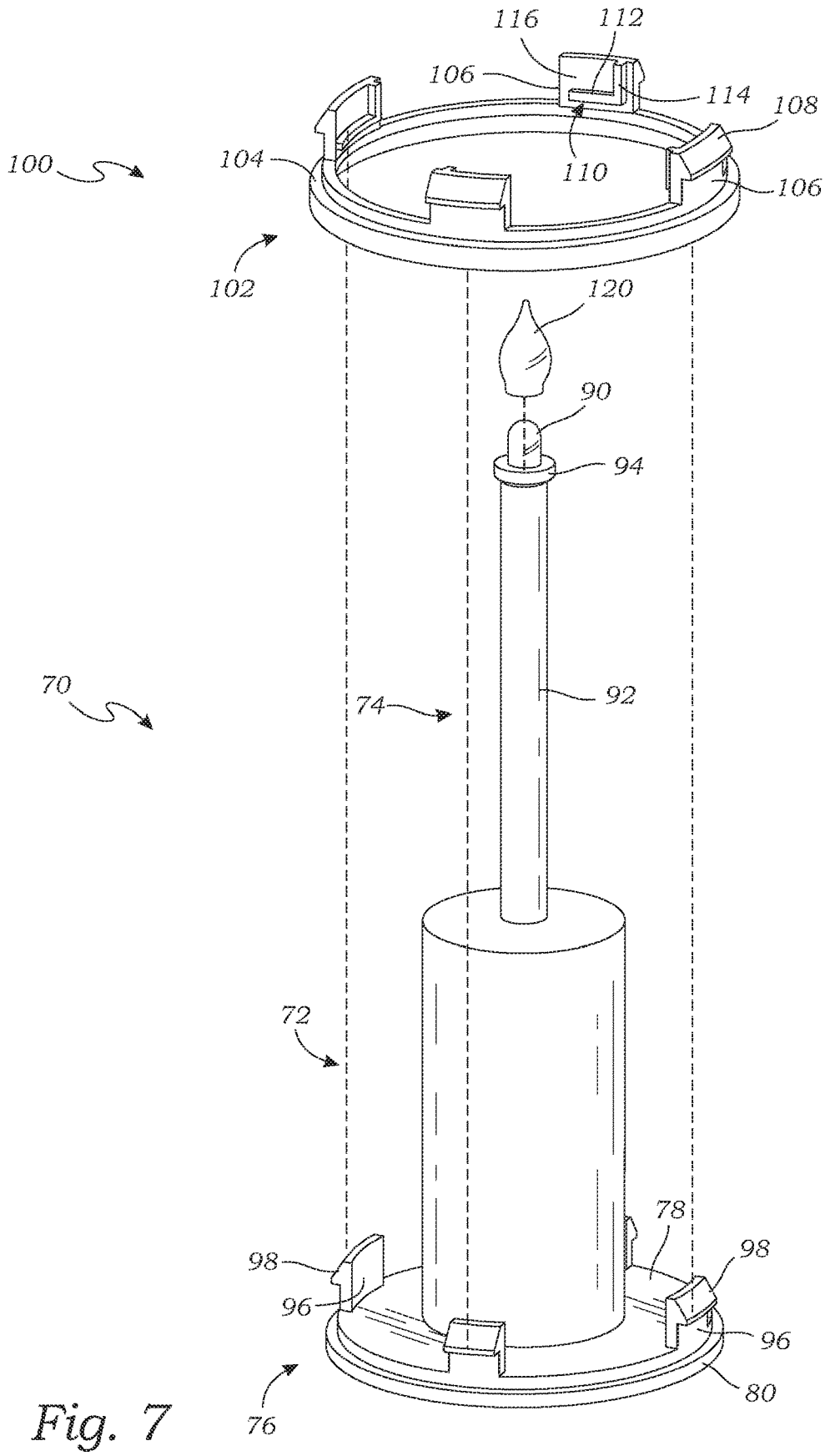
FIG. 7 is an exploded top perspective view of an alternative exemplary light unit thereof, in accordance with at least one embodiment.
Figure 8:
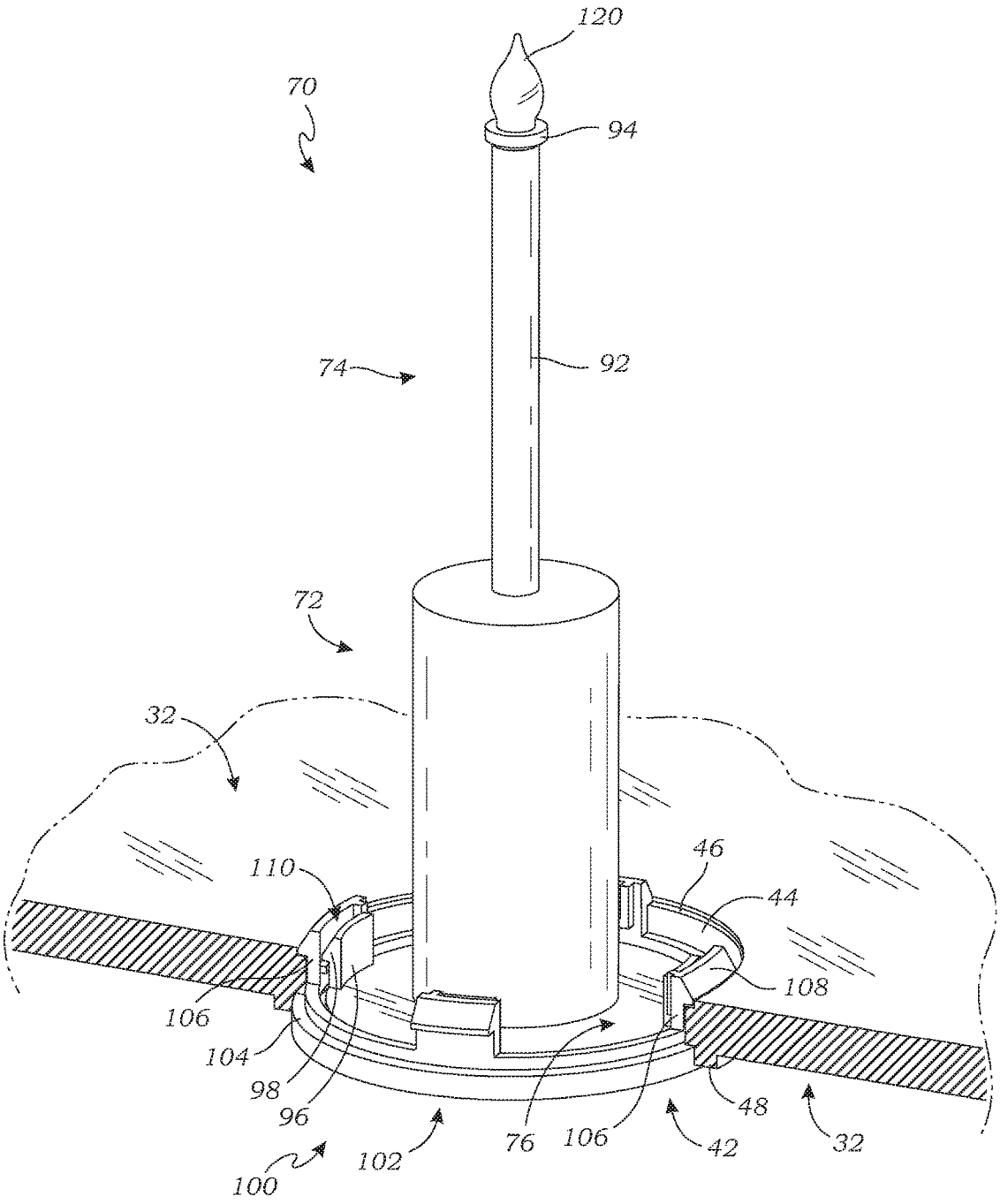
FIG. 8 is an assembled top perspective view of the light unit of FIG. 7 as installed, in accordance with at least one embodiment.

In FIGS. 7 and 8 there are shown enlarged exploded and assembled perspective views of an alternative exemplary light unit 70 according to aspects of the present invention. The light unit 70 is once more shown as comprising a main body 72 having an upwardly oriented stem 74 extending distally therefrom and an opposite base 76 formed proximally on the body 72 and configured for seating within the outlet 42 of the coin bank 30 (FIGS. 1-4). Rather than the base 76 seating directly in or against the outlet 42 as through an interference or other such fit between the perimeter of the base 76 (and particularly the upper and lower radially-outwardly-projecting flanges 78, 80 and the radially-outwardly-opening undercut 84 therebetween) and the wall 32 of the bank 30 at the outlet 42 (and particularly the radially-inwardly-projecting lip 44 bounded by the inwardly- and outwardly-opening recesses 46, 50), as described in connection with the exemplary embodiment of FIGS. 1-6, here in the alternate embodiment, a separate ring 100 is provided as being inserted within the outlet 42 and configured for selective removable engagement by the light unit 70, and particularly the base 76 thereof. As a threshold matter, it will be appreciated that while such ring 100 is shown and described as being a separate component, it or one or more of its features could also be formed integrally with the wall 32 of the bank 30 at or defining the opening 42. Where the ring 100 is a separately formed component, it will be further appreciated that it may be installed within the outlet 42 of the coin bank 30 through a bonding, press-fit, over-molding or other such technique now known or later developed. As best seen in the exploded view of FIG. 7, the exemplary ring 100 is formed having an annular stepped collar 102 defining a radially-outwardly-extending and upwardly-facing shelf 104. Around the perimeter of the collar 102 there are further formed a plurality of upwardly-projecting ring legs 106 each having a distal outwardly-extending ring foot 108 configured for selective engagement with the outlet 42. Particularly, as best seen in the assembled view of FIG. 8 where a portion of the coin bank wall 32 is depicted, the outlet 42 is again shown as being formed having a radially-inwardly-projecting lip 44 defining an inwardly-opening recess 46 and a downwardly and outwardly-projecting lip 48 defining together with the radially-inwardly-projecting lip 44 an outwardly-opening recess 50 (FIG. 3), such that proximally the upwardly-facing shelf 104 of the collar 102 may seat within the outwardly-opening recess 50 as distally the outwardly-extending feet 108 of the ring legs 106 may snap and seat within the inwardly-opening recess 46. It will be appreciated that by forming the ring 100 or at least the legs 106 and/or feet 108 of a resilient material able to flex and then return to its "at rest" position, and by providing a sloped or tapered outer surface on the feet 108, the ring 100 may thus be snapped into engagement within the coin bank outlet 42. Those skilled in the art will again appreciate that a number of permanent or removable engagement means between the ring 100 and the outlet 42, whether now known or later developed, are possible according to aspects of the present invention, such that the exemplary configuration of the ring 100 and its engagement within the outlet 42 is to be understood as illustrative and non-limiting. As best seen in FIG. 7, on the inner side of each of the ring legs 106 opposite the outwardly-extending foot 108 there is further formed a receiver 110. In the exemplary embodiment the receiver 110 is formed having a bottom ledge 112 and a stop 114 extending upwardly from one end of the ledge 112 so as to form an opening 116 at the other end of the ledge 112. The base 76 of the light unit 70 is then formed having complimentary features, namely, an upper radially-outwardly-projecting flange 78 and a stepped or enlarged lower radially-outwardly-projecting flange 80 together configured to seat within the stepped collar 102 of the ring 100. Furthermore, a plurality of upwardly-projecting base legs 96 are formed spaced about the upper radially-outwardly-projecting flange 78 of the base 76 substantially corresponding to the plurality of upwardly-projecting ring legs 106. Like the ring legs 106, each base leg 96 is further formed with a distal outwardly-extending foot 98 here configured for selective engagement with the receiver 110 of the respective ring leg 106. More particularly, in the exemplary embodiment, as again best appreciated from FIG. 8, the outwardly-extending foot 98 is configured to seat over or against the respective bottom ledge 112 of the receiver 110. And as with the feet 108 of the ring legs 106, the feet 98 of the base legs 96 may be formed having a sloped outer surface to facilitate pushing or snapping the base legs 96 into the mounting ring 100 as by flexing the base legs 96 inwardly until the base 76 is sufficiently inserted distally into the ring 100 such that the base feet 98 are above and clear of the ledges 112. Again, then, it will be appreciated that the base 76 and particularly the base legs 96 may be formed of any suitable material now known or later developed, including but not limited to plastic, rubber or metal. And once more, any such components or features may be formed integrally as through an injection molding, stamping, machining or other such process now known or later developed or may be formed separately and then assembled, again employing any materials or techniques now known or later developed. Notably, and whether or not any of the components of the ring 100 or base 76 are resilient, rather than snapping the feet 98 of the base legs 96 over the ledges 112 of the receivers 110 of the respective ring legs 106 as by pushing the base 76 into the ring 100 directly axially with the base legs 96 and ring legs 106 substantially aligned, it will be appreciated that by forming the receivers 110 with openings 116 along one side of the ledges 112 opposite the stops 114, the light unit 70 and thus the base 76 can instead be inserted at an angularly-offset position such that the base legs 96 are clear of the ring legs 106 initially. Then, upon full insertion, or pushing the light unit 70 fully into the coin bank 30 so as to seat the base 76 within the ring 100, and particularly the stepped flanges 78, 80 against the stepped collar 102, then rotating the light unit 70 relative to the ring 100 would cause the outwardly-extending feet 98 of the base legs 96 to slide over the ledges 112 of the respective receivers 110 of the respective ring legs 106 as by passing through the openings 116. It will be appreciated that the vertical stops 114 formed opposite the respective openings 116 would then provide a stop for such rotational movement and ensure proper positioning of the light unit base 76 relative to the ring 100 and thus engagement between the outwardly-extending feet 98 of the base legs 96 and the ledges 112 of the respective receivers 110 of the respective ring legs 106. To remove the light unit 70, it may simply be rotated relative to the ring 100 in the opposite direction until the outwardly-extending feet 98 of the base legs 96 are clear of the ledges 112 and thus of the respective receivers 110 of the respective ring legs 106, so that the light unit 70 may then be axially withdrawn from the coin bank outlet 42. Once more, those skilled in the art will appreciate that a variety of other such structure for keying or selectively removably engaging the light unit 70 within the bank outlet 42, here as equipped with a ring 100 but not necessarily so, are possible according to aspects of the present invention without departing from its spirit and scope, such that the alternative exemplary embodiment shown and described in connection with FIGS. 7 and 8 is to be understood as merely illustrative and non-limiting. In any case, engagement between the base 76 of the light unit 70 and the outlet 42 of the coin bank 30 may again be circumferential or full or only partial, as here evidenced in the alternative exemplary embodiment wherein the engagement between both the ring 100 and the coin bank outlet 42 and between the base 76 of the light unit 70 and the ring 100 are at four points. Those skilled in the art will of course appreciate that while four base legs 96 and four associated ring legs 106 are illustrated, the invention is not so limited, but instead any number, spacing, and configuration of such legs 96, 106 are possible according to aspects of the present invention. Again, the base 76 may be formed so as to be unitary with and of the same material as the body 72 of the light unit 70 or may be formed of a different material to suit such selective installation of the light unit 70 within the coin bank 30, with such base 76 or portion thereof of different material being then installed on the balance of the light unit 70 as through a bonding, press-fit, over-molding or other such technique now known or later developed. Those skilled in the art will appreciate that all such structure and related assemblies now known or later developed may be employed according to aspects of the present invention without departing from its spirit and scope.

With continued reference to FIGS. 7 and 8, once more, the stem 74 of the light unit 70 may be rigid or flexible and formed of any suitable material and in any appropriate configuration now known or later developed for the purpose of elevating the light source 90 installed on the distal end of the stem 74 and in exemplary embodiments positioning the light source 90 so as to not be directly beneath the coin slot 52 of the coin bank 30 (FIGS. 3 and 4). As also shown, at the distal end of the shaft 92 there may again be formed a mount 94 configured as an annular flange or shelf on which the light source 90 may be operably installed. In the alternative embodiment, a cover 120 may be formed so as to further seat on the mount 94 or be otherwise affixed on the stem 92 over at least a portion of the light source 90 such as an LED bulb so as to further protect the light source 90 from damage, whether from falling coins C (FIG. 10), while inserting the light unit 70 into the bank 30, or otherwise. As shown, the cover 120 may be configured to resemble a flame, but such is merely illustrative and non-limiting of the present invention.

Referring next to FIGS. 9-11, there are shown sectional views of the exemplary coin bank night light apparatus 20 according to aspects of the present invention similar to that of FIG. 4, now in use. First, as shown in FIG. 9, there is illustrated such a coin bank night light apparatus 20 having the coin bank 30 with the light unit 70 removably engaged therewith so as to extend within the interior of the coin bank 30, again just as shown in FIG. 4. Here, a plurality of coins C have been inserted within the coin bank 30, urged downwardly simply by gravity and so piled along and contained by the bottom and sides of the bank's outer wall 32. The base 76 of the light unit 70 being seated in the bank's outlet 42 thus again serves to plug the outlet 42 as would instead the traditional plug (not shown) and so retain the deposited coins C within the bank 30. It will be appreciated that even with a relatively large quantity of coins C in the bank 30, due to the design of the light unit 70 and particularly the generally upward orientation of the body 72 and stem 74, the light source 90 at the distal or upper end of the stem 74 is clear of and not at all obstructed or obscured by the coins C. Next, as shown in FIG. 10, additional coins C may at any point be inserted into the coin bank 30 as by manually taking one or more coins C in hand H and dropping, pushing or otherwise inserting them through the slot 52 formed in the upper region of the bank's outer wall 32. As will be appreciated, not only does the configuration of the light unit 70, and the stem 74 specifically, enable the light 90 to be unaffected or unobscured by the coins C, but by design in terms of one or both of the coin bank 30 and the light unit 70, the horizontal location of the light source 90 is offset relative to the coin slot 52, such that the entering, falling coins C would not strike the light source 90 so as to possibly damage it. Once more, in the exemplary embodiment, the light unit 70 is substantially straight or vertically arranged and the desired offset is achieved through the positioning of the outlet 42 (FIGS. 1 and 3) and the coin slot 52 such that they are not aligned vertically. Alternatively, as explained above, instead of or in addition to the offset positioning of the coin slot 52 relative to the outlet 42 of the coin bank 30, the light unit 70, such as the stem 74 thereof, may be formed at an angle or configured to be selectively adjustable to an angular or offset position so as to thus effectively position the light source 90 off-axis relative to the base 76 of the light unit 70 and thus the outlet 42 of the coin bank 30. Accordingly, the coin bank 30 may be used effectively and conveniently to store coins C while conveniently incorporating lighting functionality essentially in the coin banks' outlet plug, which again is defined by the base 76 of the light unit 70. Turning then to FIG. 11, there is shown the exemplary coin bank night light apparatus 20 as again containing some quantity of coins C within the coin bank 30, now with the light unit 70 operated to provide illumination outwardly from the light source 90, shown as radially-outwardly-projecting arrows going in a plurality of directions. In the exemplary embodiment, there are again one or more first openings 54 formed in the first outwardly-projecting "pig ear" features 34, one or more second openings 56 formed in the second outwardly-projecting "pig tail" feature 36, and one or more third openings 58 formed in the outer wall 32 itself. As illustrated, the radially-outwardly-projecting arrows representing light emitted from the light source 90 are shown in the directions of the first, second and third openings 54, 56, 58, as well as possibly the coin slot 52, though it will be appreciated that the light would be emitted in effectively all directions within the coin bank 30, such that the illustrated light emissions are not exhaustive, it being further appreciated that light not aligned with an opening 54, 56, 58, at least initially, would instead bounce or be reflected off of the inside surface of the outer wall 32 of the coin bank 30 and perhaps eventually make its way through an opening 54, 56, 58 due effectively to the ambient light effect that would be created within the coin bank 30 even by a single light source 90. Again, multiple light sources 90 are also possible according to aspects of the present invention. In any event, a reflective coating or paint or other surface treatment now known or later developed may be provided on all or part of the inside surfaces of the bank's outer wall 32 to further facilitate such light reflection. While it is possible, then, that light may also exit the coin bank 30 through the coin slot 52, were this not desirable, for example, a slitted rubber gasket or the like (not shown) could be positioned within the slot 52 to prevent light from escaping therethrough while still allowing coins C to be inserted, as by pushing them through the slit in the coin slot gasket, the slit otherwise remaining closed. As illustrated, once more, the configuration of the light unit 70 with the light source 90 elevated away from the bottom of the coin bank 30 and from the pile of coins C is the primary facilitator of the desired light emission from the light source 90 and out of the coin bank 30 through one or more of the openings 54, 56, 58. It will be appreciated that such effect may be achieved in a wide variety of configurations of the light unit 70 and of the openings 54, 56, 58 beyond those illustrated, such that the invention is to be understood as not being so limited. In the exemplary embodiment, as also illustrated in FIG. 11, activation of the light unit 70 and of the light source 90 particularly is accomplished by simply "flipping" the switch 86, or here shifting or sliding the switch 86 from a first "off" position to a second "on" position indicated by the arrow adjacent to the switch 86 pointing to the left. It will once again be appreciated that a variety of controls for selective operation of the light unit 70 now known or later developed may be employed, as described elsewhere herein.

Figure 12:
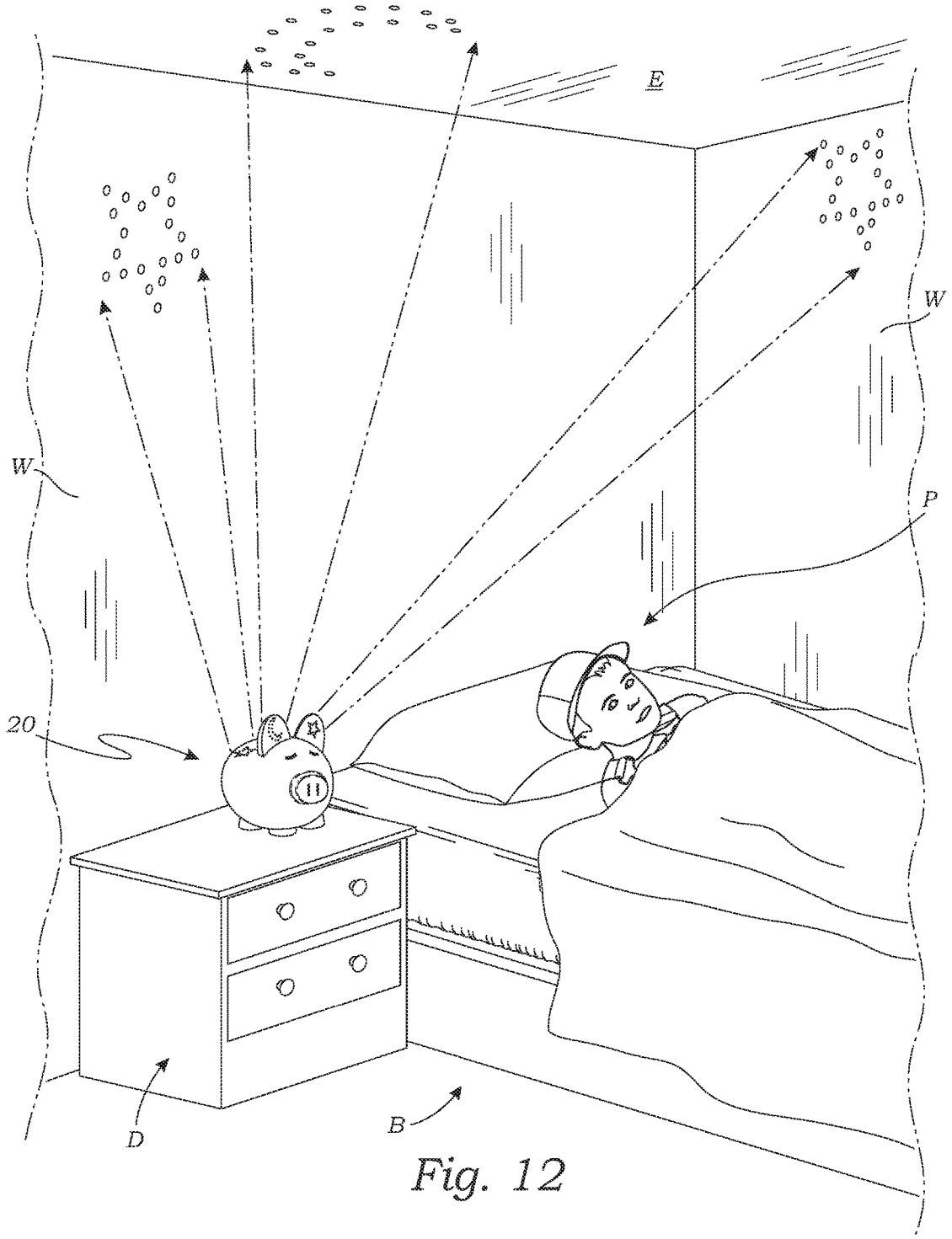
FIG. 12 a reduced scale perspective view of the exemplary coin bank night light of FIGS. 1-4 in use in the third operational mode illustrated in FIG. 11, in accordance with at least one embodiment.

Finally, turning briefly to FIG. 12, there is illustrated an exemplary coin bank night light apparatus 20 according to aspects of the present invention similar to that of FIGS. 1-4 now in use as being positioned on a dresser D adjacent to a bed B in a room R. As shown, when the light unit 70 thereof is activated, light from the light source 90 may exit the coin bank 30 as above-described, here through the multiple first openings 54 formed in each of the pig ear first outwardly-projecting features 34, with a set of openings 54 in one ear 34 forming a crescent moon pattern and a set of openings 54 in the other ear 34 forming a star pattern, for example. Similarly, as shown in FIGS. 3 and 4, another pattern of second openings 56 may be formed in the pig tail second outwardly-projecting feature 36, though not visible in the illustration of FIG. 12. And as shown here, an exemplary set of third openings 58 may be formed in an upper region of the coin bank outer wall 32 again in a star pattern, for example. Then, as illustrated, with the light unit 70 "on" or activated, the light projecting through the various openings 54, 56, 58 may then form the same patterns of light on the walls W and/or ceiling E of the room R, again, such as a moon or star pattern. In that way, a person P lying in the bed B, for example, may enjoy the light effects from the coin bank night light apparatus 20 while again conveniently still storing his or her coins in the coin bank 30. This may be entertaining and soothing to the person P and thereby help induce sleep. The light unit 70 may nevertheless remain "on" all night or for the duration of the person's sleep, who may then switch the light unit 70 "off" when he or she awakes, or the light may simply go "off" on its own after a set period of time through a setting incorporated in the unit 70 as herein described. And even if the light 70 is configured or set to be relatively dimmer or otherwise does not form in cooperation with the coin bank 30 and its openings 54, 56, 58 distinct patterns on the walls W and/or ceiling E as illustrated, it will be further appreciated that nevertheless a soothing and attractive "glow" from the coin bank night light apparatus 20 will be produced regardless when the light unit 70 is inserted and activated, again advantageously without compromising the function of the coin bank 30 itself in storing coins C or the function of the light unit 70 when coins C are stored. Those skilled in the art will appreciate that there is thus provided a somewhat universal coin bank night light 70 that conveniently may be removably engaged with a number of coin banks 30 and thereby provide improved function and aesthetics as herein described. That is, the light unit 70 may be selectively engaged with any coin bank 30 having an outlet 42 or other such opening sized and configured for accommodation of the light unit 70, which is achieved, for example, by forming the base 76 somewhat universally so as to removably seat within a typical, particular coin bank outlet 42 in the place of its usual plug. Accordingly, the light unit 70 is effectively a stand-alone invention that may be sold and used separately from any particular coin bank 30, with the present invention then further described as effectively the combination of such a light unit 70 with a coin bank 30.

Aspects of the present specification may also be described as follows:

1. A coin bank night light apparatus comprising a coin bank and a light unit removably engageable therewith.

2. The coin bank night light apparatus according to embodiment 1, wherein the coin bank comprises an outlet and the light unit comprises a base configured to be selectively seated within the outlet.

3. The coin bank night light apparatus according to embodiment 2, wherein a ring is installed in the outlet and configured to selectively removably receive the base of the light unit.

4. The coin bank night light apparatus according to embodiments 2-3, wherein the outlet is horizontally offset from a coin slot of the coin bank.

5. The coin bank night light apparatus according to embodiments 1-4, further wherein the light unit is configured having a stem with a light source to be positioned within the coin bank when the light unit is removably engaged therewith.

6. The coin bank night light apparatus according to embodiment 4, wherein the stem is articulable.

7. The coin bank night light apparatus according to embodiments 1-5, further wherein the coin bank is formed having one or more openings.

8. The coin bank night light apparatus according to embodiment 7, wherein the one or more openings are formed in an outer wall of the coin bank.

9. The coin bank night light apparatus according to embodiments 7-8, wherein the one or more openings are formed in an outwardly-projecting feature of the coin bank.

10. A coin bank night light apparatus comprising a coin bank having an outer wall defining a hollow interior and further having a coin slot, an outlet, and at least one opening each formed in the outer wall so as to communicate with the hollow interior, and a light unit having a base configured for selective engagement with the coin bank outlet and further having a body extending from the base and a stem extending from the body and terminating opposite the base in a light source, whereby the light unit is removably insertable within the coin bank and, upon insertion of the light unit within the coin bank as by passing the light source, stem, and body through the outlet into the hollow interior and engaging the base with the outlet and further upon selective illumination of the light source, light from the light source fills the hollow interior of the coin bank and passes out of the hollow interior through the at least one opening.

11. The apparatus of any of embodiments 2-10 wherein the coin bank outlet comprises a radially-inwardly-projecting lip.

12. The apparatus of embodiment 11 wherein the light unit base comprises a radially-outwardly-opening undercut configured for receipt of the radially-inwardly-projecting lip in selectively engaging the base with the outlet so as to removably insert the light unit within the coin bank.

13. The apparatus of embodiment 12 wherein the radially-inwardly-projecting lip of the coin bank outlet defines an inwardly-opening recess, and the radially-outwardly-opening undercut of the light unit base is defined by an upper radially-outwardly-projecting flange and an opposite spaced-apart lower radially-outwardly-projecting flange, the upper radially-outwardly-projecting flange configured to seat against the inwardly-opening recess of the outlet.

14. The apparatus of embodiment 11 wherein the coin bank outlet further comprises an outwardly-projecting lip defining an outwardly-opening recess.

15. The apparatus of embodiment 14 wherein the light unit base further comprises a lower radially-outwardly-projecting flange configured to seat against the outwardly-opening recess of the outlet.

16. The apparatus of any of embodiments 2-15 further comprising a ring configured for selective engagement with the coin bank outlet, the ring comprising a collar having a plurality of inwardly-projecting ring legs each having a radially-outwardly-extending ring foot configured to engage an inwardly-opening recess defined by the radially-inwardly-projecting lip of the outlet.

17. The apparatus of embodiment 16 wherein the collar further comprises a shelf offset from the plurality of inwardly-projecting ring legs and configured to seat against an outwardly-opening recess of the outlet.

18. The apparatus of embodiment 17 wherein each inwardly-projecting ring leg is formed having a radially-inwardly-oriented receiver comprising a substantially horizontal ledge and a substantially vertical stop extending upwardly from an edge of the ledge, the ledge and the stop cooperating to form an opening.

19. The apparatus of embodiment 18 wherein the light unit base further comprises a plurality of inwardly-projecting base legs extending from the base substantially parallel to and spaced from the body and substantially corresponding to the plurality of inwardly-projecting ring legs, the base legs each being further formed having a base foot configured for selectively engaging the respective ring receiver as by entering the opening and seating against one or both of the ledge and the stop so as to selectively engage the base with the outlet so as to removably insert the light unit within the coin bank.

20. The apparatus of any of embodiments 5-19 wherein the stem comprises a substantially vertical shaft terminating opposite the body in a light source mount, and the light source is operably installed on the mount.

21. The apparatus of embodiment 20 wherein the light source is shielded by a cover installed over the light source on the mount.

22. The apparatus of any of embodiments 5-21 wherein the light source is an LED.

23. The apparatus of any of embodiments 2-22 wherein the light unit base further comprises a bottom wall.

24. The apparatus of embodiment 23 wherein the bottom wall comprises a switch for selective operation of the light source.

25. The apparatus of embodiment 23 or embodiment 24 wherein the bottom wall comprises a battery door for selective access within the light unit body.

26. The apparatus of any of embodiments 5-25 wherein the light source is positioned atop the stem so as to be suspended within the hollow interior of the coin bank above coins inserted within the interior of the coin bank through the coin slot.

27. The apparatus of any of embodiments 5-26 wherein the outlet is vertically offset from the coin slot so that coins falling into the interior space through the coin slot do not impact the light source.

28. The apparatus of any of embodiments 5-26 wherein the outlet is vertically aligned with the coin slot and the stem is angled relative to the body so that coins falling into the interior space through the coin slot do not impact the light source.

29. The apparatus of any of embodiments 8-28 wherein the outer wall further comprises at least one outwardly-projecting feature.

30. The apparatus of embodiment 29 wherein the at least one opening is formed in the at least one outwardly-projecting feature.

31. The apparatus of embodiment 29 or embodiment 30 wherein the coin bank comprises first openings formed in the outer wall and second openings formed in the at least one outwardly-projecting feature.

32. The apparatus of any of embodiments 29-31 wherein the coin bank comprises at least a first outwardly-projecting feature and a second outwardly-projecting feature.

33. The apparatus of embodiment 32 wherein at least one first opening is formed in the first outwardly-projecting feature and at least one second opening is formed in the second outwardly-projecting feature.

34. A method of employing a coin bank night light apparatus as defined in any one of embodiments 1-33, the method comprising the steps of inserting the light unit into the coin bank so that the light source is positioned within the hollow interior of the coin bank and selectively illuminating the light source so that light from the light source fills the hollow interior of the coin bank and passes out of the hollow interior through the at least one opening.

35. The method of embodiment 34, further comprising the step of engaging the light unit base with the coin bank outlet.

36. The method of embodiment 34 or embodiment 35, wherein the step of selectively illuminating the light source comprises actuating the switch positioned on the bottom wall of the light unit.

37. The method of any of embodiments 34-36, further comprising positioning the coin bank night light apparatus within a room so that the light passing through the at least one opening displays a pattern on one or more of a wall and a ceiling.

38. The method of any of embodiments 34-37, further comprising inserting one or more coins into the hollow interior of the coin bank through the coin slot.

39. The method of any of embodiments 34-38, further comprising the steps of removing the light unit from the coin bank as by disengaging the light unit base from the coin bank outlet and retrieving the coins from the coin bank through the coin bank outlet.

40. A kit comprising a coin bank night light apparatus as defined in any one of embodiments 1-33.

41. The kit of embodiment 40, further comprising instructional material.

42. The kit of embodiment 41, wherein the instructional material provides instructions on how to perform the method as defined in any one of embodiments 34-39.

43. Use of a coin bank night light apparatus as defined in any one of embodiments 1-33 to selectively store coins and selectively provide illumination from within the coin bank.

44. The use of embodiment 43, wherein the use comprises a method as defined in any one of embodiments 34-39.

In closing, regarding the exemplary embodiments of the present invention as shown and described herein, it will be appreciated that a coin bank night light apparatus is disclosed and configured for removably engaging a light unit with a number of coin banks so as to thereby provide improved function and aesthetics. Because the principles of the invention may be practiced in a number of configurations beyond those shown and described, it is to be understood that the invention is not in any way limited by the exemplary embodiments, but is generally directed to a coin bank night light comprising a coin bank and a light unit removably engageable therewith and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled and supported herein for the phrases "consisting essentially of" and "consisting of."

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

The methods as described above may be used in the fabrication of integrated circuit chips. The resulting integrated circuit chips can be distributed by the fabricator in raw wafer form (that is, as a single wafer that has multiple unpackaged chips), as a bare die, or in a packaged form. In the latter case, the chip is mounted in a single chip package (such as a plastic carrier, with leads that are affixed to a motherboard or other higher level carrier) or in a multi-chip package (such as a ceramic carrier that has either or both surface interconnections or buried interconnections). In any case, the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

While aspects of the invention have been described with reference to at least one exemplary embodiment, it is to be clearly understood by those skilled in the art that the invention is not limited thereto. Rather, the scope of the invention is to be interpreted only in conjunction with any appended claims here or in any patent application claiming the benefit hereof, and it is made clear that the inventor(s) believe that the claimed subject matter is the invention.

What is claimed is:

1. A coin bank night light apparatus comprising:

a coin bank having an outer wall defining a hollow interior and further having a coin slot, an outlet, and at least one opening each formed in the outer wall so as to communicate with the hollow interior; and a light unit having a base configured for selective engagement with the coin bank outlet and further having a body extending from the base and a stem extending from the body and terminating opposite the base in a light source, whereby the light unit is removably insertable within the coin bank and, upon insertion of the light unit within the coin bank as by passing the light source, stem, and body through the outlet into the hollow interior and engaging the base with the outlet and further upon selective illumination of the light source, light from the light source fills the hollow interior of the coin bank and passes out of the hollow interior through the at least one opening.

2. The apparatus of claim 1 wherein the coin bank outlet comprises a radially-inwardly-projecting lip.

3. The apparatus of claim 2 wherein the light unit base comprises a radially-outwardly-opening undercut configured for receipt of the radially-inwardly-projecting lip in selectively engaging the base with the outlet so as to removably insert the light unit within the coin bank.

4. The apparatus of claim 3 wherein:

the radially-inwardly-projecting lip of the coin bank outlet defines an inwardly-opening recess; and the radially-outwardly-opening undercut of the light unit base is defined by an upper radially-outwardly-projecting flange and an opposite spaced-apart lower radially-outwardly-projecting flange, the upper radially-outwardly-projecting flange configured to seat against the inwardly-opening recess of the outlet.

5. The apparatus of claim 2 further comprising a ring configured for selective engagement with the coin bank outlet, the ring comprising a collar having a plurality of inwardly-projecting ring legs each having a radially-outwardly-extending ring foot configured to engage an inwardly-opening recess defined by the radially-inwardly-projecting lip of the outlet.

6. The apparatus of claim 5 wherein the collar further comprises a shelf offset from the plurality of inwardly-projecting ring legs and configured to seat against an outwardly-opening recess of the outlet.

7. The apparatus of claim 6 wherein each inwardly-projecting ring leg is formed having a radially-inwardly-oriented receiver comprising a substantially horizontal ledge and a substantially vertical stop extending upwardly from an edge of the ledge, the ledge and the stop cooperating to form an opening.

8. The apparatus of claim 7 wherein the light unit base further comprises a plurality of inwardly-projecting base legs extending from the base substantially parallel to and spaced from the body and substantially corresponding to the plurality of inwardly-projecting ring legs, the base legs each being further formed having a base foot configured for selectively engaging the respective ring receiver as by entering the opening and seating against one or both of the ledge and the stop so as to selectively engage the base with the outlet so as to removably insert the light unit within the coin bank.

9. The apparatus of claim 1 wherein:

the stem comprises a substantially vertical shaft terminating opposite the body in a light source mount; and the light source is operably installed on the light source mount.

10. The apparatus of claim 9 wherein the light source is shielded by a cover installed over the light source on the mount.

11. The apparatus of claim 1 wherein:

the light unit base further comprises a bottom wall; and the bottom wall comprises a switch for selective operation of the light source.

12. The apparatus of claim 1 wherein the light source is positioned atop the stem so as to be suspended within the hollow interior of the coin bank above coins inserted within the interior of the coin bank through the coin slot.

13. The apparatus of claim 12 wherein the outlet is vertically aligned with the coin slot and the stem is angled relative to the body so that coins falling into the interior space through the coin slot do not impact the light source.

14. The apparatus of claim 1 wherein the outer wall further comprises at least one outwardly-projecting feature.

15. The apparatus of claim 14 wherein the at least one opening is formed in the at least one outwardly-projecting feature.

16. The apparatus of claim 14 wherein the coin bank comprises first openings formed in the outer wall and second openings formed in the at least one outwardly-projecting feature.

17. A method of employing a coin bank night light apparatus as defined in claim 1, the method comprising the steps of:

inserting the light unit into the coin bank so that the light source is positioned within the hollow interior of the coin bank as by engaging the light unit base with the coin bank outlet; and selectively illuminating the light source so that light from the light source fills the hollow interior of the coin bank and passes out of the hollow interior through the at least one opening.

18. The method of claim 17, further comprising:

inserting one or more coins into the hollow interior of the coin bank through the coin slot;

removing the light unit from the coin bank as by disengaging the light unit base from the coin bank outlet; and retrieving at least one of the one or more coins from the coin bank through the coin bank outlet.

19. A coin bank night light apparatus comprising:

a coin bank having an outer wall defining a hollow interior and further having a coin slot, an outlet, and at least one opening each formed in the outer wall so as to communicate with the hollow interior, the outlet comprising a radially-inwardly-projecting lip; and a light unit having a base configured for selective engagement with the coin bank outlet and a light source opposite the base so as to be positionable within the hollow interior of the coin bank, the light unit base comprising a radially-outwardly-opening undercut configured for receipt of the radially-inwardly-projecting lip in selectively engaging the base with the outlet so as to removably insert the light unit within the coin bank, whereby the light unit is removably insertable within the coin bank and, upon insertion of the light unit within the coin bank as by passing the light source through the outlet into the hollow interior and engaging the base with the outlet and further upon selective illumination of the light source, light from the light source fills the hollow interior of the coin bank and passes out of the hollow interior through the at least one opening.

20. A coin bank night light apparatus comprising:

a coin bank having an outer wall defining a hollow interior and further having a coin slot and an outlet each formed in the outer wall so as to each communicate with the hollow interior, wherein the outer wall further comprises at least first openings formed in the outer wall and second openings formed in the at least one outwardly-projecting feature, the first and second openings being formed in the outer wall so as to also communicate with the hollow interior; and a light unit having a base configured for selective engagement with the coin bank outlet and a light source opposite the base so as to be positionable within the hollow interior of the coin bank, whereby the light unit is removably insertable within the coin bank and, upon insertion of the light unit within the coin bank as by passing the light source through the outlet into the hollow interior and engaging the base with the outlet and further upon selective illumination of the light source, light from the light source fills the hollow interior of the coin bank and passes out of the hollow interior through the first and second openings.

* * * * *